US011953011B2

(12) United States Patent
Krutzenbichler et al.

(10) Patent No.: US 11,953,011 B2
(45) Date of Patent: Apr. 9, 2024

(54) PUMP WITH A CONVEYOR DEVICE AT LEAST FOR CONVEYING A FLUID, AND SUCH A CONVEYOR DEVICE

(71) Applicant: Watson Marlow GmbH, Rommerskirchen (DE)

(72) Inventors: Alois Krutzenbichler, Starnberg (DE); Lars Freiherr Varnbuler Von Und Zu Hemmingen-Redschlag, Wiernsheim-Pinache (DE); Raymond Ritschka, Weissach (DE); Nico Haug, Sindelfingen (DE)

(73) Assignee: Watson Marlow GmbH, Rommerskirchen (DE)

( * ) Notice: Subject to any disclaimer, the term of this patent is extended or adjusted under 35 U.S.C. 154(b) by 0 days.

(21) Appl. No.: 17/755,215

(22) PCT Filed: Oct. 22, 2020

(86) PCT No.: PCT/EP2020/079823
§ 371 (c)(1),
(2) Date: Apr. 22, 2022

(87) PCT Pub. No.: WO2021/078902
PCT Pub. Date: Apr. 29, 2021

(65) Prior Publication Data

US 2022/0397114 A1 Dec. 15, 2022

(30) Foreign Application Priority Data

Oct. 23, 2019 (DE) ..... 102019128680.8

(51) Int. Cl.
*F04C 5/00* (2006.01)
*F04B 43/08* (2006.01)
(Continued)

(52) U.S. Cl.
CPC ..... *F04C 5/00* (2013.01); *F04B 43/08* (2013.01); *F04B 43/12* (2013.01); *F04B 53/16* (2013.01); *F04B 53/22* (2013.01)

(58) Field of Classification Search
CPC .. F04C 5/00; F04B 43/08; F04B 43/12; F04B 53/16; F04B 53/22
See application file for complete search history.

(56) References Cited

U.S. PATENT DOCUMENTS 2,885,966 A 5/1959 Reginald
3,408,947 A 11/1968 McMillan
(Continued)

FOREIGN PATENT DOCUMENTS

DE 29714484 U1 10/1997
DE 102012023900 A1 6/2014
(Continued)

OTHER PUBLICATIONS

English Translation DE-102017104400-A1 (Year: 2018).*
(Continued)

*Primary Examiner* — Shafiq Mian
(74) *Attorney, Agent, or Firm* — Honigman LLP; Brett A. Krueger; John Chau

(57) ABSTRACT

"The disclosure relates to a pump at least for conveying a fluid, comprising at least one conveyor device which has at least one conveyor chamber, at least one dimensionally stable conveyor chamber element that at least partly delimits the conveyor chamber, and at least one elastically deformable conveyor element that together with the conveyor chamber element delimits the conveyor chamber and is arranged on the conveyor chamber element; at least one drive unit for acting on the conveyor device; and at least one housing for receiving the conveyor device, wherein the housing is formed at least separately from the conveyor
(Continued)

chamber element of the conveyor device, in particular from the conveyor device as a whole, in particular such that the conveyor chamber element, in particular the conveyor device, can be removed as a whole from the housing."

10 Claims, 7 Drawing Sheets

(51) Int. Cl.

| | |
|---|---|
| ***F04B 43/12*** | (2006.01) |
| ***F04B 53/16*** | (2006.01) |
| ***F04B 53/22*** | (2006.01) |

(56) References Cited

U.S. PATENT DOCUMENTS

| | | | | |
|---|---|---|---|---|
| 3,883,272 | A | 5/1975 | Puckett | |
| 4,332,534 | A * | 6/1982 | Becker | F04B 43/0054 418/153 |
| 5,006,049 | A * | 4/1991 | von der Heyde | F04C 5/00 417/479 |
| 5,988,998 | A * | 11/1999 | Glover | F04C 5/00 418/56 |
| 2016/0215768 | A1 * | 7/2016 | Minatodani | F04B 43/14 |
| 2018/0051564 | A1 | 2/2018 | Braxmaier et al. | |
| 2018/0216615 | A1 * | 8/2018 | Hodgson | F01N 3/2066 |

FOREIGN PATENT DOCUMENTS

| | | | | |
|---|---|---|---|---|
| DE | 102017104400 | A1 * | 9/2018 | F04B 43/0054 |
| DE | 102017104400 | A1 | 9/2018 | |
| EP | 2733355 | A1 * | 5/2014 | F04B 43/0054 |
| EP | 2733355 | A1 | 5/2014 | |
| JP | S36-9686 | | 7/1961 | |
| RU | 2472032 | C1 | 1/2013 | |
| SU | 261912 | A1 | 1/1970 | |
| WO | 2012126544 | A1 | 9/2012 | |
| WO | 2016173798 | A1 | 11/2016 | |
| WO | 2018158423 | A1 | 9/2018 | |

OTHER PUBLICATIONS

International Search Report, Application No. PCT/EP2020/079823, dated Nov. 30, 2020. ISA/European Patent Office.
German Patent Office Search Report, Application No. 10 2019 128 680.8, dated Aug. 13, 2020.
Intellectual Property India First Examination Report, Application No. 202227021863, dated Aug. 23, 2022.
IPRP and Written Opinion of the International Bureau of WIPO, International Application No. PCT/EP2020/079823, dated May 5, 2022.
Russian Office Action, Applicaiton No. 2022113564, dated Dec. 28, 2022.
Search Report, Russian Application No. 2022113564, dated Dec. 27, 2022.
Russian Decision to Grant, Application No. 2022113564, dated Apr. 3, 2023.
Japanese Office Action, Application No. JP 2022-523287, dated May 30, 2023.
Canadian Office Action, Application No. 3,158,193, dated Jun. 23, 2023.
Australian Examination Report No. 1, Application No. 2020370731, dated Aug. 18, 2023.
Korean Office Action issued in Application No. 10-2022-7016943 dated Dec. 26, 2023, 20 pages.
Korean Notice of Allowance issued in Application No. 2022-523287 dated Jan. 9, 2024, 2 pages.

* cited by examiner

PUMP WITH A CONVEYOR DEVICE AT LEAST FOR CONVEYING A FLUID, AND SUCH A CONVEYOR DEVICE

CROSS-REFERENCE TO RELATED APPLICATIONS

This application is the U.S. national stage of PCT/EP2020/079823 filed on Oct. 22, 2020, which claims priority of German Patent Application No. 10 2019 128 680.8 filed on Oct. 23, 2019, the contents of which are incorporated herein.

TECHNICAL FIELD

The disclosure relates to a conveyor device for at least conveying a fluid and to a pump comprising such a conveyor device.

BACKGROUND

A pump for at least conveying a fluid is already known from DE 10 2017 104 400 A1, the pump comprising at least one conveyor device which has at least one conveyor chamber, at least one dimensionally stable conveyor chamber element which at least partly delimits the conveyor chamber, and at least one elastically deformable conveyor element which, together with the conveyor chamber element, delimits the conveyor chamber and is arranged on the conveyor chamber element, at least one drive unit for acting on the conveyor device, and at least one housing for receiving the conveyor device.

Furthermore, a pump for at least conveying a fluid is already known from DE 10 2012 023 900 A1, wherein the pump comprises at least one conveyor device formed as an elastically deformable pump hose which has at least one conveyor chamber, one elastically deformable conveyor chamber element and at least one elastically deformable conveyor element which together with the conveyor chamber element delimits the conveyor chamber and is arranged integrally with the conveyor chamber element, wherein the conveyor chamber element is formed from a stronger material than the conveyor element, but is still elastic per se.

Furthermore, a pump for at least conveying a fluid is already known from DE 297 14 484 U1, wherein the pump comprises at least one conveyor device which has at least one conveyor chamber, at least one dimensionally stable conveyor chamber element which at least partially delimits the conveyor chamber, and at least one elastically deformable conveyor element which together with the conveyor chamber element delimits the conveyor chamber and is arranged on the conveyor chamber element, and at least one drive unit for acting on the conveyor device and at least one housing for receiving the conveyor device, the housing being formed at least separately from the conveyor chamber element of the conveyor device.

SUMMARY

The object of the disclosure is, in particular, to provide a generic pump and/or conveyor device with improved properties with regard to an advantageous serviceability and/or conveying function. According to the disclosure, the object is achieved by the features of claim 1, while advantageous configurations and refinements of the disclosure can be derived from the subclaims.

The disclosure is based on a pump at least for conveying a fluid, comprising at least one conveyor device which has at least one conveyor chamber, at least one dimensionally stable conveyor chamber element which at least partly delimits the conveyor chamber, and at least one elastically deformable conveyor chamber element which, together with the conveyor chamber element, delimits the conveyor chamber and is arranged on the conveyor chamber element, at least one drive unit for acting on the conveyor device and comprising at least one housing for receiving the conveyor device, wherein the housing is formed at least separately from the conveyor chamber element of the conveyor device, in particular from the conveyor device as a whole, in particular in such a manner that the conveyor chamber element, in particular the conveyor device, can be removed as a whole from the housing.

It is proposed that the conveyor chamber element has an outer face which, in a state when the conveyor device is arranged on the housing, is connected in a force-fitting and/or form-fitting manner to an inner face of the housing and which in particular rests against the inner face of the housing, wherein the conveyor chamber element, at least to a large extent, surrounds the conveyor element along a circumferential direction running in a plane extending at least substantially perpendicular to a drive axis of the drive unit. In a state when the conveyor device, in particular the conveyor device as a whole, is arranged in the housing, the outer face of the conveyor chamber element preferably rests at least partly against the inner face of the housing, in particular at least against an inner face of a housing lower part of the housing. Preferably, more than 30%, preferably more than 40%, particularly preferably less than 95% and most preferably between 40% and 60% of a total outer surface of the outer face of the conveyor chamber element rests against the inner face of the housing, in particular against the inner face of the housing lower part of the housing. The housing, in particular the housing lower part, preferably comprises a recess in which the conveyor device can be arranged, in particular is arranged. The recess of the housing, in particular of the housing lower part, is preferably delimited by a collar-like extension in the interior of the housing, in particular of the housing lower part. The collar-like extension extends over less than 360°, in particular to allow for an arrangement of an inlet and outlet region of the conveyor device in the housing, in particular in the housing lower part. Preferably, the outer face of the conveyor chamber element is arranged at a distance relative to an inner face of a housing upper part of the housing, at least along a direction extending at least substantially perpendicular to the drive axis of the drive unit. However, it is also conceivable that the housing upper part has a collar-like extension which has a recess for at least partly receiving the conveyor chamber element, in particular the conveyor device, against which the outer face of the conveyor chamber element rests. Other configurations for an arrangement of the conveyor device in the interior of the housing which appear to make sense to a person skilled in the art are also conceivable.

A "unit/device formed separately from [ . . . ] or an element formed separately from [ . . . ]" is to be understood here to mean in particular a unit/device or an element which can be removed as a whole, in particular non-destructively or without disassembling individual parts, from, in particular, a further element or from a further unit, such as, for example, from the housing, in particular at least from the housing lower part of the housing or the like, in particular after disassembling the housing upper part of the housing or after detaching at least one fastening element provided for fastening the unit to the element or the further unit. In particular, the conveyor device is functional in a state when removed from the housing. "Provided" is to be understood to mean, in particular, specially adapted, specially designed and/or specially equipped. By the fact that an element and/or a unit are/is provided to perform a specific function, it is to be understood in particular that the element and/or the unit perform/performs and/or executes this specific function in at least one application and/or operating state. Preferably, the conveyor device can be removed from the housing without disassembling into individual parts of the conveyor device, in particular as a whole. Preferably, at least the conveyor chamber element and the conveyor element can be removed together from the housing. Preferably, the conveyor device, in particular as a whole, can be replaced after removal by an exchange or replacement device which, with respect to at least one function of the exchange or replacement device, corresponds at least substantially to at least one function of the conveyor device. Preferably, the pump is provided for use in a food sector, in a chemical sector, in a pharmaceutical sector, in particular for use in a batch-compatible manner, in a vivarium sector (aquarium, etc.), in a household machine sector, in a dental hygiene sector, in an automotive sector, in a medical sector, in a water treatment sector or the like.

Preferably, the conveyor element comprises a base body. In particular, the base body comprises at least one conveyor side and at least one activation side. Preferably, the conveyor side of the base body is arranged on a side of the base body facing away from the activation side of the base body. In particular, the conveyor side forms an outer face of the basic body. Preferably, the activation side forms an inner face of the basic body. Preferably, at least one activation extension of the conveyor element is arranged on the activation side. Preferably, the activation extension is provided to cooperate with a transmission element of the drive unit, in particular with at least two transmission elements of the drive unit. Preferably, the transmission element(s) is/are arranged on a drive element of the drive unit. Preferably, the base body has an annular configuration. Preferably, the base body has a slotted annular configuration. In particular, the base body, viewed in a plane, in particular in a plane extending at least substantially perpendicular to a drive axis of the drive axis, has a cross-sectional shape which is substantially composed of a circular arc or an open ring extending along an angular range of less than 360° and, in particular, of more than 90°, and two inlet and/or outlet extensions which extend transversely to the circular arc or to the open ring and which are directly adjacent to the circular arc or to the open ring, in particular in end regions of the circular arc or of the open ring. The activation extension is preferably arranged in the region of a circular arc course or an annular course of the base body on the base body, in particular on an inner face of the base body. The expression "substantially perpendicular" is intended in particular to define an orientation of a direction relative to a reference direction, wherein the direction and the reference direction, in particular as viewed in a projection plane, enclose an angle of 90° and the angle has a maximum deviation of in particular less than 8°, advantageously less than 5° and particularly advantageously less than 2°. A maximum longitudinal extent of the activation extension is in particular at least 5%, preferably 10% and particularly preferably at least 20% smaller than a maximum longitudinal extent of the base body. Preferably, the activation extension extends at least substantially along an overall extent of the circular arc or the open ring of the basic body, in particular up to end regions of the circular arc or the open ring, at which an inlet and/or outlet extension of the basic body is arranged in each case. Preferably, the activation extension extends along an angular range of, in particular, less than 360°, preferably of less than 350° and particularly preferably of more than 180° on the activation side.

Advantageously, the conveyor chamber element, in particular the conveyor membrane, can be moved away from a counter surface of the conveyor chamber element, in particular lifted off the counter surface, as a result of the action of a driving force acting in a direction away from the activation side, in particular for generating a negative pressure in the conveyor chamber. Preferably, as a result of a movement of the conveyor device, in particular of the conveyor membrane, away from the counter surface, a negative pressure can be generated which is in particular smaller than −0.1 bar, preferably smaller than −0.2 bar and particularly preferably smaller than −0.3 bar, in particular relative to an atmospheric pressure surrounding the conveyor device. An advantageous conveyance of a conveying medium into the conveyor chamber of the conveyor device, which is at least partly delimited by a counter surface of the conveyor chamber element and a conveyor surface of the conveyor element, can be achieved.

Preferably, the conveyor element, in particular the conveyor membrane, can be driven by means of the drive unit in such a manner that conveying a conveying medium, in particular a fluid, according to a migrating wave principle (cf. for example the disclosure of EP 1 317 626 B1) is made possible. The drive unit can be designed as a mechanical drive unit, as a magnetic drive unit, as a piezoelectric drive unit, as a hydraulic drive unit, as a pneumatic drive unit, as an electric drive unit, as a magnetorheological drive unit, as a carbontubes drive unit, as a combination of one of the aforementioned types of drive units or as any other drive unit that appears to make sense to a person skilled in the art. Preferably, the drive unit comprises at least the drive element which is provided to act on the conveyor element, in particular the conveyor membrane. However, it is also conceivable that the drive unit has a number of drive elements other than one, which are provided to act on the conveyor element. Preferably, the drive element is provided to effect an elastic deformation of the conveyor element, in particular of the conveyor membrane, as a result of the action of a driving force on the conveyor element, in particular the conveyor membrane. The drive element can have any configuration that appears to make sense to a person skilled in the art, such as a configuration as a plunger, as an extension, as an engagement ring, as a hook, as a gripping element or the like. Preferably, the drive element is formed as an eccentric shaft. Preferably, the eccentric shaft can be rotatingly driven by means of a motor unit of a pump, which comprises the conveyor device, in a manner already known to a person skilled in the art. The motor unit can be configured as an electric motor unit, an internal combustion engine unit, a hybrid motor unit, or the like. The drive element preferably has an axis of rotation. The axis of rotation preferably runs transverse, in particular at least substantially perpendicular, to a main conveying direction of the conveyor chamber, along which a fluid can be conveyed through the conveyor chamber.

The conveyor chamber of the conveyor device is preferably delimited by the base body of the conveyor element and the conveyor chamber element. The conveyor chamber of the conveyor device is preferably delimited by the conveyor surface and the counter surface opposite the conveyor surface. The conveyor chamber element is preferably dimensionally stable. Preferably, the conveyor chamber element is under a preload, in particular to apply a force to the conveyor element in the direction of the drive unit and/or a pressing unit of the conveyor device. Preferably, the conveyor element, in particular the conveyor membrane, is configured to be spring-elastic. "Spring-elastic" is to be understood in particular as a property of an element, in particular the conveyor element, which is provided in particular for generating a counterforce which depends on a change in a shape of the element and is preferably proportional to the change and which counteracts the change. The conveyor element, in particular the conveyor membrane, is preferably repeatedly deformable, in particular without the conveyor element, in particular the conveyor membrane, being mechanically damaged or destroyed as a result thereof. Preferably, the conveyor element, in particular the conveyor membrane, in particular after a deformation, is automatically aiming again for a basic shape, in particular a basic shape convexly curved with respect to the counter surface, in particular a zero position, of the conveyor element, in particular of the conveyor membrane. Preferably, the spring-elastic configuration of the conveyor element, in particular of the conveyor membrane, can be at least partially influenced and/or created by means of a configuration, in particular a geometric configuration, of the base body and/or by means of an arrangement of the conveyor element, in particular of the conveyor membrane, on the conveyor chamber element having the counter surface. The conveyor element, in particular the conveyor membrane, is preferably arranged on the conveyor chamber element having the counter surface in such a manner that a fluid is conveyed in and/or through the conveyor chamber as a result of the conveyor element, in particular the conveyor membrane, bulging in. After the effect of a driving force on the conveyor element, in particular the conveyor membrane, to convey a fluid is removed, the conveyor surface of the conveyor element, in particular of the conveyor membrane, returns to an arrangement that is convexly curved with respect to the counter surface, preferably at least substantially automatically, in particular as a result of the spring-elastic configuration. The conveyor element, in particular the conveyor membrane, is preferably formed from a rubber-like and/or caoutchouc-like material. However, it is also conceivable that the conveyor device, in particular the conveyor membrane, is formed from another material which appears to make sense to a person skilled in the art, or from a combination of several materials, which allows or allow a spring-elastic configuration of the conveyor element, in particular the conveyor membrane. Preferably, the conveyor element, in particular the conveyor membrane, uses a "bulging-in effect" to convey a fluid in and/or through the conveyor chamber. The conveyor element, in particular the conveyor surface, can preferably at least temporarily bulge in for conveying a fluid, wherein at least one bulge is displaceable, in particular displaceable in a rolling manner, along the conveyor surface for conveying a fluid. "Provided" is to be understood to mean in particular specially adapted, specially designed and/or specially equipped. By the fact that an element and/or a unit are/is provided for a specific function, it is to be understood in particular that the element and/or the unit fulfil/fulfils and/or perform/performs this specific function in at least one application and/or operating state.

By means of the configuration according to the disclosure, a convenient exchange or removal of the conveyor device as a whole from the housing can be implemented in a particularly advantageous manner. Advantageously, a high level of serviceability can be achieved. Advantageously, service and assembly costs can be kept low.

Furthermore, it is proposed that the housing, at least to a large extent, surrounds the conveyor chamber element, in particular the conveyor device, along a circumferential direction running in a plane extending at least substantially perpendicular to a drive axis of the drive unit. Preferably, the pump comprises at least one, in particular the aforementioned drive unit having at least one, in particular the aforementioned drive element, in particular at least one eccentric shaft which is surrounded, to a large extent, by the conveyor chamber element, the conveyor element and a pressing unit of the conveyor device, in particular viewed along a circumferential direction extending around the drive axis of the drive unit. Preferably, the drive unit, in particular at least the drive element, is completely surrounded by the conveyor chamber element, the conveyor element and the pressing unit, in particular viewed along the circumferential direction running around the drive axis of the drive unit. Preferably, the housing completely surrounds at least the conveyor chamber element, in particular the conveyor device, along the circumferential direction running in the plane extending at least substantially perpendicular to the drive axis of the drive unit. Preferably, the conveyor chamber element surrounds the conveyor element, at least to a large extent, along the circumferential direction running in the plane extending at least substantially perpendicular to the drive axis of the drive unit. Preferably, the conveyor chamber element completely surrounds the conveyor element along the circumferential direction running in the plane extending at least substantially perpendicular to the drive axis of the drive unit. By means of the configuration according to the disclosure, an encapsulation of the conveyor device can be advantageously achieved. It is particularly advantageous that the conveyor device can be replaced or removed as a whole from the housing in a convenient manner. Advantageously, a high level of serviceability can be achieved. Advantageously, service and assembly costs can be kept low.

In addition, it is proposed that the conveyor chamber element, viewed along a direction running transverse to a drive axis of the drive unit, is arranged at least between the housing and the conveyor element of the conveyor device, in particular directly adjacent to the housing and the conveyor element or directly resting against the housing and the conveyor element. It is conceivable that a gap, in particular a small gap, is present at least between the conveyor chamber element and the housing, in particular the housing lower part and/or the housing upper part, in particular in order to allow for a clearance for an arrangement of the conveyor device in the housing. By means of the configuration according to the disclosure, an encapsulation of the conveyor element in the housing can be advantageously achieved. It is particularly advantageous that replacing or removing the conveyor device as a whole from the housing can be implemented in a comfortable manner, in particular because at least the conveyor element together with the conveyor chamber element can be removed from the housing. Advantageously, a high level of serviceability can be achieved. Advantageously, service and assembly costs can be kept low.

Furthermore, the disclosure is based on a conveyor device, in particular the aforementioned conveyor device, for a pump, in particular for the pump according to the disclosure, wherein the conveyor device comprises at least one conveyor chamber element, in particular the aforementioned conveyor chamber, at least one conveyor chamber element, in particular formed separately from a housing, in particular the aforementioned housing, and at least partially delimiting the conveyor chamber, which is formed in a dimensionally stable manner, and at least one elastically deformable conveyor element, in particular the aforementioned conveyor chamber element, in particular the aforementioned conveyor element, in particular the conveyor membrane, which together with the conveyor chamber element delimits the conveyor chamber and is arranged on the conveyor chamber element, wherein the conveyor chamber element surrounds the conveyor element, at least to a large extent, along a circumferential direction running in a plane extending at least substantially perpendicular to the drive axis of a drive unit, in particular of the aforementioned the drive unit. It is proposed that the conveyor chamber element is formed, at least to a large extent, in particular completely, from a plastic material, in particular from an injection-moulded plastic material. However, it is also conceivable that the conveyor chamber element is formed from a different material that appears to make sense to a person skilled in the art, such as, for example, from a biodegradable material, from a metal or the like, and/or that the conveyor chamber element is produced by means of a different production method that appears to make sense to a person skilled in the art, such as, for example, by means of a 3D printing method, by means of a tensioning method, by means of a milling process, by means of a die-casting process or the like. Preferably, the conveyor chamber element completely surrounds the conveyor element along the circumferential direction running in particular in the plane extending at least substantially perpendicular to the drive axis of the drive unit. Preferably, the conveyor element is arranged, at least to a large extent, in particular completely, within the, in particular annular, conveyor chamber element. By means of the configuration according to the disclosure, a weight-optimised configuration can be advantageously implemented. A cost-effective production can be made possible. Advantageously, encapsulating the conveyor element in the conveyor chamber element can be achieved.

Furthermore, it is proposed that the conveyor chamber element is annular in shape. Preferably, the conveyor chamber element has a slotted annular configuration. In particular, the conveyor chamber element, viewed in a plane, in particular in a plane extending at least substantially perpendicular to a drive axis of the drive unit, has a cross-sectional shape which is substantially composed of a circular arc or an open ring extending along an angular range of less than 360° and in particular of more than 90°, and two transverse extensions extending transverse to the circular arc or to the open ring, which directly adjoin the circular arc or the open ring, in particular in end regions of the circular arc or the open ring. By means of the configuration according to the disclosure, receiving the conveyor element within the conveyor chamber element can be implemented in a structurally simple manner.

Moreover, it is proposed that the conveyor chamber element has a counter surface, in particular the aforementioned counter surface, which cooperates with a conveyor surface of the conveyor element, in particular the aforementioned conveyor surface, for conveying a fluid, which counter surface faces the conveyor element and has at least one elevation directed in the direction of the conveyor element. Preferably, the counter surface comprises at least two elevations facing towards the conveyor element. Preferably, the counter surface comprises at least one recess facing away from the conveyor element. Preferably, the counter surface extends over at least three successive circular arc sections, in particular as viewed in a cross-section. The circular arc sections preferably form the counter surface. Two of the three circular arc sections preferably form two elevations of the counter surface and are arranged on the outside. One of the three arc sections preferably forms the recess and is arranged on the inside, in particular arranged spatially between the two elevations. It is conceivable that the three circular arc sections have different or the same radii. By means of the configuration according to the disclosure, efficient conveying of a fluid can be advantageously implemented. Particularly advantageously, a reliable conveyance of a fluid can be achieved.

It is further proposed that viewed along the circumferential direction, the elevation extends at least substantially along the entire inner face of the conveyor chamber element, which extends in particular in a circular arc-shaped manner. The inner face of the conveyor chamber element preferably faces the conveyor element, in particular the conveyor surface of the conveyor element. By means of the configuration according to the disclosure, an efficient conveyance of a fluid can be advantageously implemented. Particularly advantageously, a reliable conveyance of a fluid can be achieved.

It is also proposed that the conveyor chamber element has at least one connecting region arranged in particular on an inner face of the conveyor chamber element, in particular at least one connecting groove, preferably sealing groove, in which at least one edge region of the conveyor element, in particular an extension, preferably sealing extension, of the conveyor element arranged on the edge of the conveyor element engages, in particular sealingly engages, in a state when arranged on the conveyor chamber element. Preferably, the conveyor element comprises the sealing extension which is formed integrally with the base body of the conveyor element and, in a state when the conveyor element is arranged on the conveyor chamber element, is arranged at least partly in a sealing groove of the conveyor chamber element. "Integrally" is in particular to be understood to mean at least firmly bonded, for example by a welding process, an adhesive process, an injection moulding process and/or another process which appears to make sense to a person skilled in the art, and/or advantageously formed in one piece, such as by a production using a casting and/or by a production using a single-component or multi-component injection moulding process and advantageously using a single blank. Preferably, the sealing extension is arranged on the conveyor side of the base body of the conveyor element. In particular, the sealing extension on the conveyor side extends across the conveyor surface of the conveyor element, in particular viewed along a direction extending at least substantially perpendicular to the conveyor surface. Preferably, the sealing extension has a sealing projection which extends across the conveyor surface along the direction which is at least substantially perpendicular to the conveyor surface. Viewed in a plane that is at least substantially perpendicular to a main conveying direction of the conveyor chamber along which a fluid is conveyable through the conveyor chamber, the sealing projection has a cross-section that has a semi-circular or elliptical shape. However, it is also conceivable that the sealing projection has a different cross-section that appears to make sense to a person skilled in the art. The sealing projection or the entire sealing extension is arranged in a bead-like manner on an outer edge of the base body. The sealing projection has a main direction of extent which is aligned at least substantially perpendicular to the conveyor surface, in particular aligned in a direction away from the conveyor side.

Preferably, the sealing groove has a shape corresponding to the sealing extension, in particular at least to the sealing projection, in particular a corresponding cross-section. Preferably, the sealing groove has a U-shaped cross-section, in particular as viewed in the plane extending at least substantially perpendicular to the main conveying direction of the conveyor chamber. Preferably, the sealing groove is arranged on an inner face of the conveyor chamber element facing the conveyor element. Preferably, the sealing groove is arranged in an outer edge region of the conveyor chamber element. Preferably, the sealing groove has a maximum distance from an outer edge of the conveyor chamber element, which outer edge forms a transition between the inner face facing the conveyor element and an outer face of the conveyor chamber element facing away from the conveyor element, which distance is in particular less than 15 mm, preferably less than 10 mm, particularly preferably less than 8 mm and most preferably has a value between 12 mm and 6 mm. Preferably, the sealing groove has a maximum distance from the outer edge of the conveyor chamber element which corresponds in particular to at least one half, in particular 50%, of a maximum transverse extent of the sealing groove, preferably corresponds to at least the maximum transverse extent of the sealing groove and particularly preferably corresponds to a multiple of the maximum transverse extent of the sealing groove. The maximum transverse extent preferably runs at least substantially parallel to the drive axis of the drive unit and/or at least substantially perpendicular to the main conveying direction of the conveyor chamber. "Substantially parallel" is to be understood here to mean in particular an orientation of a direction relative to a reference direction, in particular in a plane, wherein the direction has a deviation with respect to the reference direction that is in particular smaller than 8°, advantageously smaller than 5° and particularly advantageously smaller than 2°. By means of the configuration according to the disclosure, an advantageous sealing effect can be achieved. Advantageously, a reliable seal can be achieved. Advantageously, leakage can be counteracted. Advantageously, an efficient conveyance of a fluid can be implemented. Particularly advantageously, a reliable conveyance of a fluid can be achieved.

Furthermore, it is proposed that the conveyor chamber element comprises at least one connection piece for a fluid supply adapter and at least one further connection piece for a fluid discharge adapter, which are arranged on a side, in particular an outer face, of the conveyor chamber element facing away from the conveyor element. The connection piece and/or the further connection piece are/is preferably arranged on at least one transverse extension of the conveyor chamber element, in particular integrally formed in with the corresponding transverse extension. The connection piece and/or the further connection piece have/has, in particular in each case, a main axis of extent which runs transverse, in particular at least substantially perpendicular to a main plane of extent of the at least one transverse extension, in particular of the respective transverse extension. Preferably, the main axis(es) of extent of the connection piece and/or of the further connection piece runs/run transverse, in particular at least substantially perpendicular to the main conveying direction of the conveyor chamber. Preferably, the main extension axis(es) of the connection piece and/or of the further connection piece runs/run at least substantially parallel to the plane running at least substantially perpendicular to the drive axis of the drive unit. The connection piece and the further connection piece are preferably arranged in different, in particular opposite, orientations on the side facing away from the conveyor element, in particular on the outer face, of the conveyor chamber element. Preferably, the connection piece and the further connection piece extend from the outer face of the conveyor chamber element in different, in particular opposite, directions. In a state when the conveyor device is arranged in the housing, the connection piece and/or the further connection piece are/is arranged at a distance relative to an inner wall of the housing, in particular at least of the housing upper part and/or of the housing lower part, in particular viewed along the main axis(es) of extent of the connection piece and/or of the further connection piece. Preferably, in a state when the conveyor device is arranged in the housing, the connection piece and/or the further connection piece are/is arranged at a distance relative to the inner wall of the housing, in particular relative to the inner face of the housing upper part and/or the inner face of the housing lower part along an entire circumference of the connecting piece and/or the further connection piece. However, it is also conceivable that, in an alternative configuration of the pump and/or the conveyor device, the connection piece and/or the further connection piece rest(s) against the inner wall of the housing, in particular against the inner face of the housing upper part and/or against the inner face of the housing lower part, in particular are/is supported on the inner wall of the housing, in particular on the inner face of the housing upper part and/or on the inner face of the housing lower part, in a state when the conveyor device is arranged in the housing. By means of the configuration according to the disclosure, efficient conveying of a fluid can be implemented. Particularly advantageously, a reliable conveyance of a fluid can be achieved. Interchangeability of the fluid supply adapter and/or the fluid discharge adapter can be achieved in a constructionally simple manner.

Furthermore, it is proposed that the conveyor element is formed, at least to a large extent, in particular completely, from a rubber, in particular a synthetic rubber. The conveyor element can be formed, for example, from an ethylene-propylene-diene (monomer) rubber (EPDM), a fluorocarbon rubber or fluoro-rubber (FKM), an acrylonitrile-butadiene rubber (NBR) or the like. Other materials which appear to make sense to a person skilled in the art are also conceivable. By means of the configuration according to the disclosure, an elastic configuration of the conveyor element can be implemented in a simple manner. Advantageously, efficient conveying of a fluid can be achieved, in particular through the automatic resetting of the conveyor element as a result of a spring-elastic configuration of the conveyor element.

The pump according to the disclosure and/or the conveyor device according to the disclosure are/is not intended to be limited to the application and embodiment described above. In particular, the pump according to the disclosure and/or the conveyor device according to the disclosure can have a number of individual elements, components and units that deviates from a number mentioned herein in order to fulfil an operating mode described herein. Furthermore, for the ranges of values disclosed in the present disclosure, values lying within the mentioned limits are also to be considered as disclosed and as usable as desired.

BRIEF DESCRIPTION OF DRAWINGS

Further advantages will be apparent from the following description of the drawings. In the drawings, an exemplary embodiment of the disclosure is shown. The drawings, the description and the claims contain numerous features in combination. A person skilled in the art will expediently also consider the features individually and combine them to form useful further combinations.

FIG. 6 shows a schematic illustration of a conveyor element of the conveyor device according to the disclosure in.

DETAILED DESCRIPTION OF THE EXEMPLARY EMBODIMENT

Figure 1:
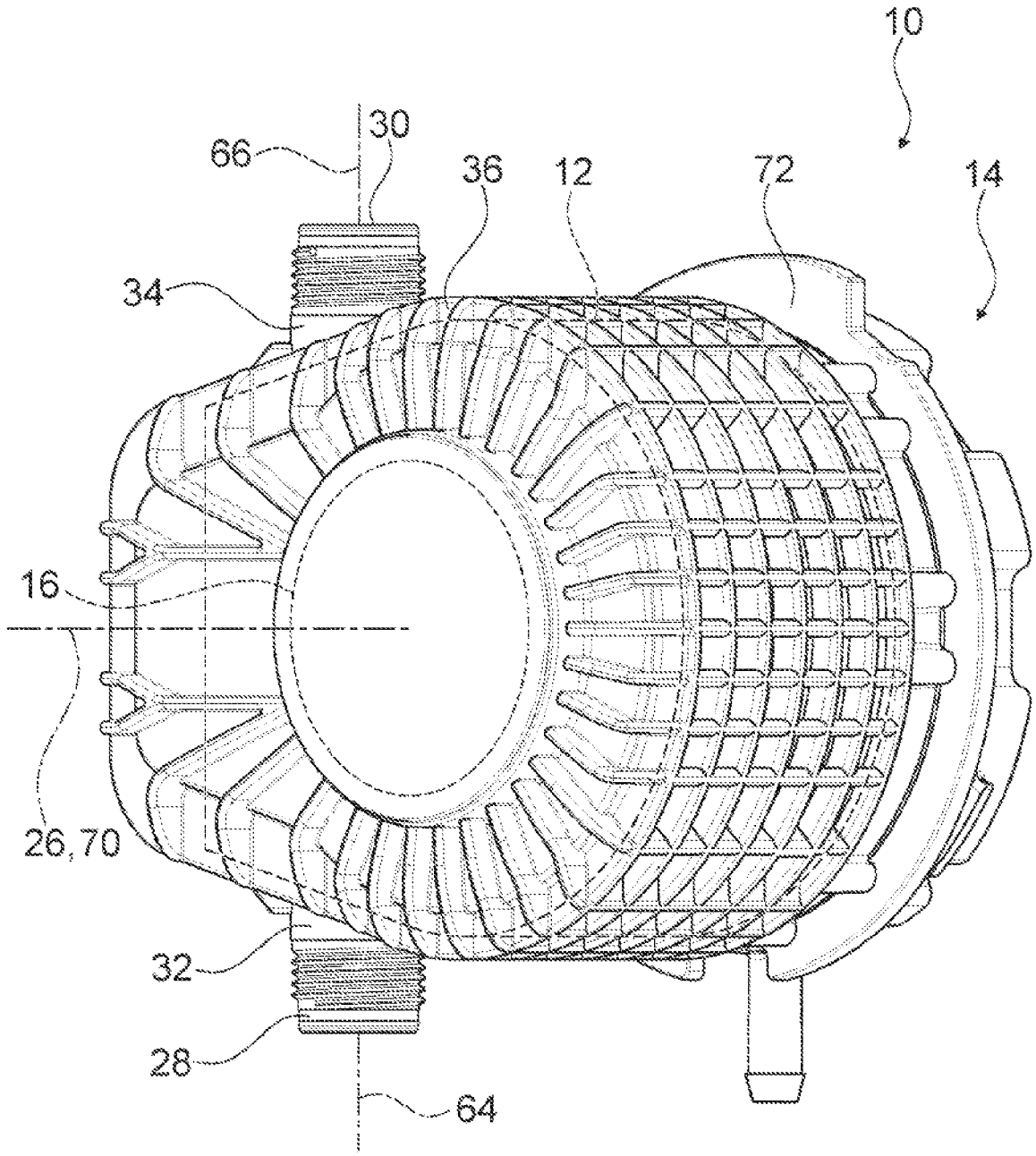
FIG. 1 shows a schematic illustration of a pump according to the disclosure with a conveyor device according to the disclosure.

FIG. 1 shows a pump 10 with at least one conveyor device 12 for conveying at least one fluid (not shown in more detail here). The conveyor device 12 is provided at least for conveying a fluid, in particular as a result of the action of a drive unit 16 of the pump 10 on the conveyor device 12, in particular on an elastically deformable conveyor element 22 of the conveyor device 12. The conveyor device 12 comprises at least one conveyor chamber 18, at least one conveyor chamber element 20 which at least partly delimits the conveyor chamber 18 and is formed to be dimensionally stable, and at least the elastically deformable, in particular annular, conveyor element 22 which together with the conveyor chamber element 20 delimits the conveyor chamber 18 and is arranged on the conveyor chamber element 20 (cf. FIG. 4). The conveyor element 22 is preferably formed as a conveyor membrane. The conveyor chamber element 20 is formed, at least to a large extent, in particular completely, from a plastic material, in particular from an injection-moulded plastic material. However, it is also conceivable that the conveyor chamber element 20 is formed from another material which appears to make sense to a person skilled in the art. The conveyor element 22 is preferably formed, at least to a large extent, in particular completely, from a rubber, in particular a synthetic rubber, such as EPDM, FKM, NBR or the like. However, it is also conceivable that the conveyor element 22 is formed from another material which appears to make sense to a person skilled in the art.

The pump 10 comprises at least the drive unit 16 for acting on the conveyor device 12 and at least one housing 14 for receiving the conveyor device 12. The drive unit 16 preferably comprises at least one drive element 24 for acting on the conveyor device 12 (cf. FIG. 4). The drive element 24 is preferably formed as an eccentric shaft. However, it is also conceivable that the drive element 24 has a different configuration that appears to make sense to a person skilled in the art, such as, for example, a rotationally symmetrical shaft on which at least one eccentric is arranged for acting on the conveyor device 12 or the like. The drive element 24 can be connected directly, in particular in a rotationally fixed manner, or indirectly, such as by means of a gear unit or by means of at least one gearwheel element, to a drive shaft of a motor unit (not shown in more detail here), such as an electric motor, an internal combustion engine, a pneumatic motor or the like. The drive element 24 has an axis of rotation 26 which runs transversely, in particular at least substantially perpendicular, to a main conveying direction along which a fluid can be conveyed through the conveyor chamber 18.

Preferably, the conveyor device 12 is arranged, at least to a large extent, in particular completely, within the housing 14. The housing 14 surrounds the conveyor device 12, at least to a large extent, in particular completely. In particular, the housing 14 is provided in a manner known to a person skilled in the art for at least partly, in particular completely, enclosing and/or supporting the conveyor device 12 and/or the drive unit 16 of the pump 10. The housing 14 can be formed from a plastic material, a metal, a combination of plastic material and metal, or any other material that appears to make sense to a person skilled in the art. The housing 14 can have a shell construction, a pot construction, a combination of a shell construction and a pot construction, or any other construction that appears to make sense to a person skilled in the art.

The housing 14 is formed at least separately from the conveyor chamber element 20 of the conveyor device 12, in particular from the conveyor device 12 as a whole, in particular in such a manner that the conveyor chamber element 20, in particular the conveyor device 12, can be removed as a whole from the housing 14. Preferably, the conveyor chamber element 20, in particular the conveyor device 12, can be removed as a whole from the housing 14 after disassembly of a housing part upper 36, in particular together with the conveyor element 22 arranged on the conveyor chamber element 20. The conveyor device 12, when decoupled from disassembly of individual parts of the conveyor device 12, can preferably be removed as a whole from the housing 14, in particular after disassembly of the housing upper part 36 of the housing 14, The housing 14 surrounds at least the conveyor chamber element 20, in particular the conveyor device 12, at least to a large extent, along a circumferential direction running in a plane extending at least substantially perpendicular to a drive axis 70 of the drive unit 16, in particular in a state when the conveyor device 12, in particular the conveyor device 12, as a whole is arranged in the housing 14.

Figure 2:
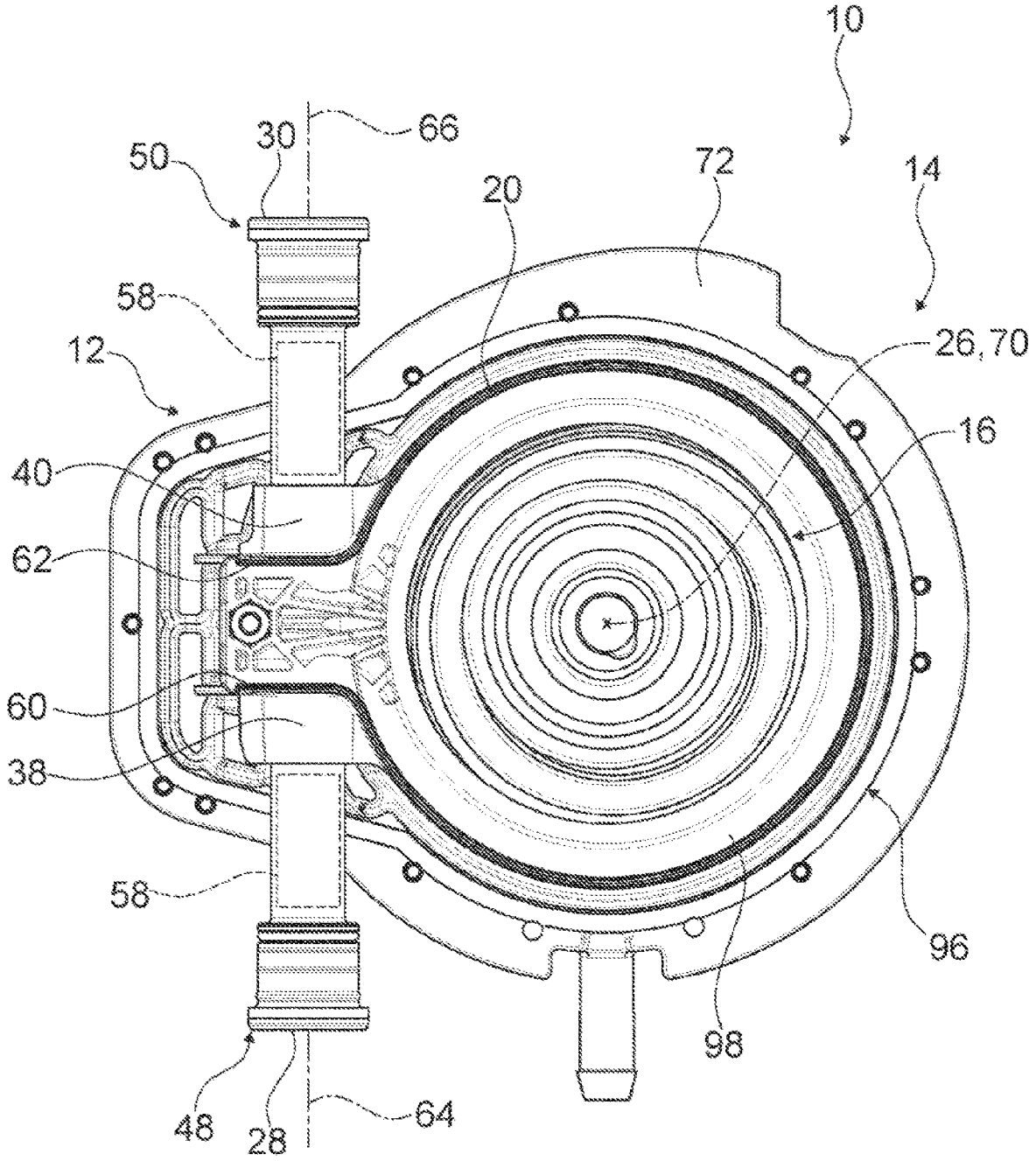
FIG. 2 shows a schematic illustration of the pump according to the disclosure with an opened housing.

The conveyor chamber element 20, as viewed along a direction extending transverse to the drive axis 70 of the drive unit 16, is arranged at least between the housing 14 and the conveyor element 22 of the conveyor device 12, in particular directly adjacent to the housing 14 or directly resting against the housing 14 (cf. FIG. 2). The conveyor device 12 at least substantially completely surrounds the drive unit 16, at least in a state when the conveyor device 12 is arranged in the housing 14, in particular along a circumferential direction running in a plane extending at least substantially perpendicular to the drive axis 70 of the drive unit 16. The conveyor chamber element 20 has an outer face which, in a state when the conveyor device 12 is arranged on the housing 14, is connected in a force-fitting and/or form-fitting manner to an inner face of the housing 14, in particular rests against the inner face of the housing 14, preferably directly. In a state when the conveyor device 12, in particular of the conveyor device 12 as a whole, is arranged in the housing 14, the outer face of the conveyor chamber element 20 preferably rests at least partly against the inner face of the housing 14, in particular at least against an inner face of a housing lower part 72 of the housing 14. Preferably, more than 30%, preferably more than 40%, particularly preferably less than 95% and most preferably between 40% and 60% of a total outer surface of the outer face of the conveyor chamber element 20 rests against the inner face of the housing 14, in particular against the inner face of a housing lower part 72 of the housing 14. The housing 14 preferably comprises a recess in which the conveyor device 12 can be arranged, in particular is arranged. The recess of the housing 14, in particular of the housing lower part 72, is preferably delimited by a collar-like extension in the interior of the housing 14, in particular of the housing lower part 72. The collar-like extension extends over less than 360°, in particular to allow for an arrangement of an inlet and outlet region of the conveyor device 12 in the housing 14, in particular in the housing lower part 72.

Furthermore, the housing 14 comprises at least one receptacle 32, in particular at least two receptacles 32, 34, for receiving at least one fluid supply adapter 28 and/or one fluid discharge adapter 30 of the conveyor device 12. The fluid supply adapter 28 is preferably provided for connecting to a fluid line, in particular in order to implement a supply of fluid to the conveyor chamber 18. The fluid discharge adapter 30 is preferably provided for connecting to a fluid line, in particular to implement a discharge of fluid from the conveyor chamber 18. Preferably, the receptacle(s) 32, 34 is/are arranged in the housing upper part 36 of the housing 14 (cf. FIGS. 1 and 3). However, it is also conceivable that the receptacle(s) 32, 34 is/are arranged in another component of the housing 14, such as in the housing lower part 72 or the like. Preferably, the fluid supply adapter 28 and/or the fluid discharge adapter 30 is/are connected to the receptacle (s) 32, 34 by means of a form- and/or force-fitting connection, in particular fixed to the receptacle(s) 32, 34. For example, the receptacle(s) 32, 34 comprise(s) an internal thread on an inner face for fixing the fluid supply adapter 28 and/or the fluid discharge adapter 30 to the housing 14, in particular to the housing upper part 36 (cf. FIG. 3). However, it is also conceivable that the fluid supply adapter 28 and/or the fluid discharge adapter 30 are arranged, in particular secured, on the receptacle(s) 32, 34 by means of a form-fitting connection, in particular a threadless connection, for example by means of insertion into the receptacle(s) 32, 34. The receptacle(s) 32, 34 extend/extend continuously from an outer face of the housing 14, in particular of the housing upper part 36, up to an inner face of the housing 14, in particular of the housing upper part 36. The receptacle(s) 32, 34 is/are preferably formed as through-opening(s) from the outer face to the inner face of the housing 14. In a state when the conveyor device 12 is arranged in the housing 14, the fluid supply adapter 28 and/or the fluid discharge adapter 30 extend/extends from the conveyor chamber element 20 at least to the outer face of the housing 14, in particular beyond it, preferably in a connected state of a connection piece 38 of the conveyor chamber element 20 with the fluid supply adapter 28 and/or in a connected state of, in particular, a further connection piece 40 of the conveyor chamber element 20 with the fluid discharge adapter 30 (cf. FIG. 3).

The connection piece 38 and/or the, in particular, further connection piece 40 are/is arranged, in particular in each case, on at least one transverse extension 60, 62 of the conveyor chamber element 20, in particular formed integrally with the corresponding transverse extension 60, 62 (cf. FIGS. 2, 3, 5 and 7). In particular, the conveyor chamber element 20, viewed in a plane, in particular in a plane extending at least substantially perpendicular to an axis of rotation 26 of the drive unit 24, in particular to the drive axis 70 of the drive unit 16, has a cross-sectional shape which consists substantially of a circular arc or an open ring, which extends along an angular range of less than 360° and in particular of more than 90°, and the two transverse extensions 60, 62 which extend transverse to the circular arc or to the open ring and which directly adjoin the circular arc or the open ring, in particular in end regions of the circular arc or of the open ring. The connection piece 38 and/or the, in particular, further connection piece 40 have/has, in particular in each case, a main axis of extent 64, 66 which runs transverse, in particular at least substantially perpendicular, to a main plane of extent of the at least one transverse extension 60, 62, in particular of the respective transverse extension 60, 62. Preferably, the main axis(es) of extent 64, 66 of the connection piece 38 and/or, in particular, of the further connection piece 40 run(s) transverse, in particular at least substantially perpendicular, to the main conveying direction of the conveyor chamber 18, along which a fluid can be conveyed through the conveyor chamber 18. Preferably, the main axis(es) of extent 64, 66 of the connection piece 38 and/or, in particular, of the further connection piece 40 extend(s) at least substantially parallel to the plane extending at least substantially perpendicular to the axis of rotation 26 of the drive element 24. The connection piece 38 and, in particular the further connection piece 40 are arranged in different, in particular opposite, orientations on the side facing away from the conveyor element 22, in particular on the outer face, of the conveyor chamber element 20. Preferably, the connection piece 38 and the, in particular, further connection piece 40 extend from the outer face of the conveyor chamber element 20 in different, in particular opposite, directions. Preferably, the connecting piece 38 and the, in particular, further connecting piece 40 extend from the outer face of the conveyor chamber element 20 in directions facing away from the conveyor chamber element 20, the directions being oriented in opposite directions.

Figure 3:
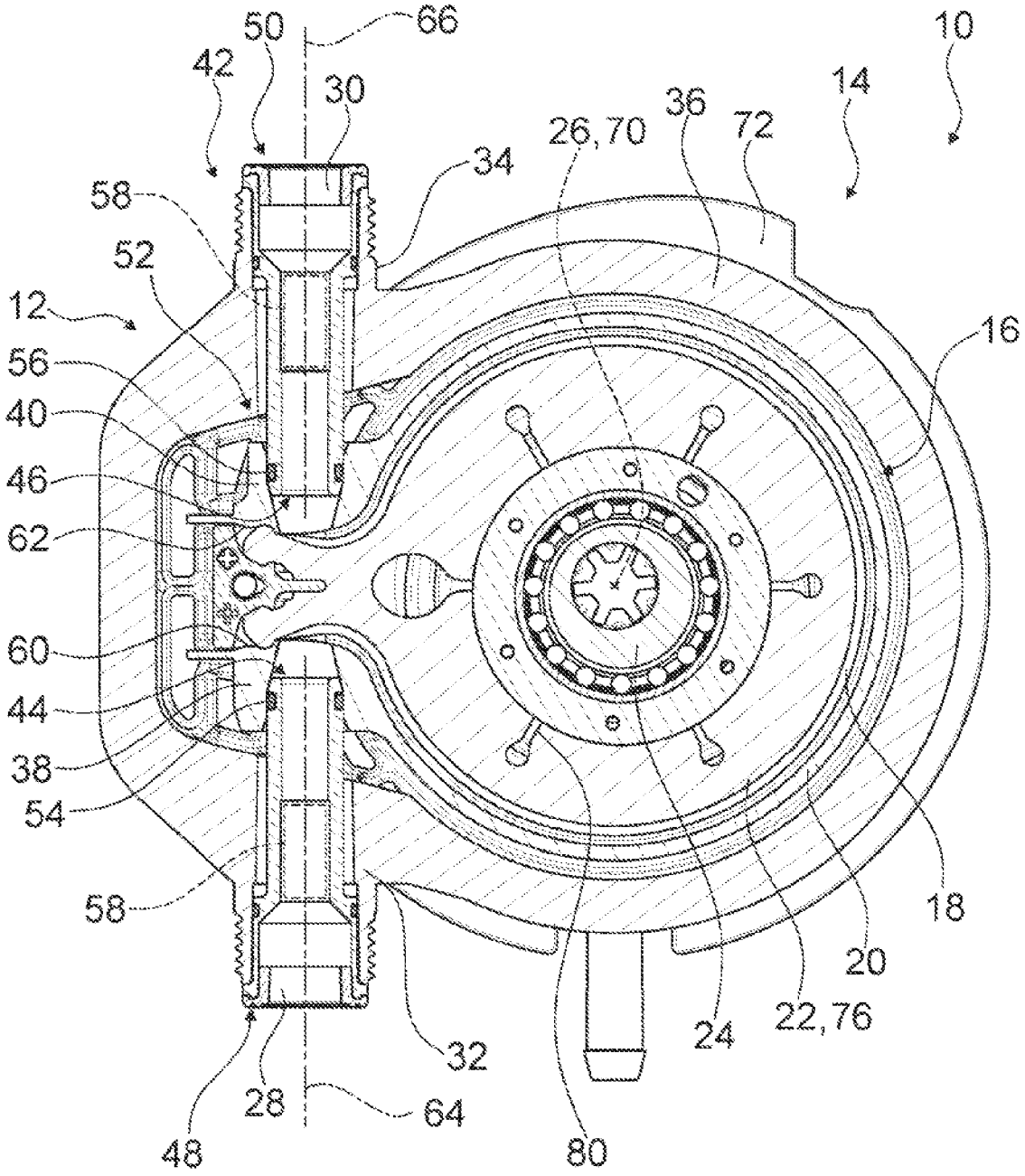
FIG. 3 shows a sectional view through the pump according to the disclosure in a schematic illustration.

In a state when the conveyor device 12 is arranged in the housing 14, the connection piece 38 and/or the, in particular, further connection piece 40 are/is arranged at a distance relative to an inner wall of the housing 14, in particular at least of the housing upper part 36 and/or of the housing lower part 72, in particular viewed along the main axis(es) of extent 64, 66 of the connection piece 38 and/or the, in particular, further connection piece 40 (cf. FIGS. 2 and 3). Preferably, in a state when the conveyor device 12 is arranged in the housing 14, the connection piece 38 and/or the, in particular, further connection piece 40 are/is arranged at a distance relative to the inner wall of the housing 14, in particular relative to an inner face of the housing upper part 36 and/or to an inner face of the housing lower part 72 along an entire circumference of the connection piece 38 and/or, in particular the further connection piece 40. In particular, a minimum distance of the connection piece 38 and/or the, in particular, further connection piece 40 relative to the inner wall of the housing 14, relative to the inner face of the housing upper part 36 and/or to the inner face of the housing lower part 72 is greater than 0.001 mm, preferably greater than 0.01 mm, particularly preferably greater than 0.1 mm and most preferably less than 10 mm. Preferably, the minimum distance of the connection piece 38 and/or the, in particular, further connection piece 40 relative to the inner wall of the housing 14, in particular relative to the inner face of the housing upper part 36 and/or to the inner face of the housing lower part 72 has a value from a range of values of 0.1 mm to 5 mm. However, it is also conceivable that, in an alternative configuration of the pump 10, the connection piece 38 and/or the, in particular, further connection piece 40 rests against the inner wall of the housing 14, in particular against the inner face of the housing upper part 36 and/or against the inner face of the housing lower part 72, in particular is supported on the inner wall of the housing 14, in particular on the inner face of the housing upper part 36 and/or on the inner face of the housing lower part 72, in a state when the conveyor device 12 is arranged in the housing 14.

The conveyor chamber element 20 comprises at least the connection piece 38 for the fluid supply adapter 28 which, in particular, is formed differently from a hose, and/or at least the, in particular, further connection piece 40 for the fluid discharge adapter 30 which, in particular, is formed differently from a hose, which are/is arranged on a side facing away from the conveyor element 22, in particular on the outer face, of the conveyor chamber element 20 (cf. FIGS. 2, 3, 5 and 7). The fluid supply adapter 28 and/or the fluid discharge adapter 30 are/is preferably tubular in shape. The fluid supply adapter 28 and/or the fluid discharge adapter 30 preferably have/has a conically extending insertion end 44, 46 (cf. FIGS. 3 and 10). The insertion end 44, 46 of the fluid supply adapter 28 and/or of the fluid discharge adapter 30 is arranged in the connection piece 38 or in the, in particular, further connection piece 40 in a state when the fluid supply adapter 28 and/or of the fluid discharge adapter 30 are/is arranged on the conveyor chamber element 20. Preferably, the fluid supply adapter 28 and/or the fluid discharge adapter 30 comprise(s) a coupling end 48, 50 for a connection with a supply line or with a discharge line to a supply line or a discharge line of a fluid from or into the conveyor chamber 18. It is also conceivable that the fluid supply adapter 28 and/or the fluid discharge adapter 30 are/is provided for a connection with other components which appear to make sense to a person skilled in the art, such as fluid coupling pieces, hose nozzles or the like. The coupling end 48, 50 is arranged on a side of the fluid supply adapter 28 or the fluid discharge adapter 30 facing away from the insertion end 44, 46. Preferably, the fluid supply adapter 28 and the fluid discharge adapter 30 have an at least substantially identical configuration. However, it is also conceivable that the fluid supply adapter 28 and the fluid discharge adapter 30 are at least partially formed differently from each other, such as in a configuration of a functional unit 58 or the like.

Figure 10:
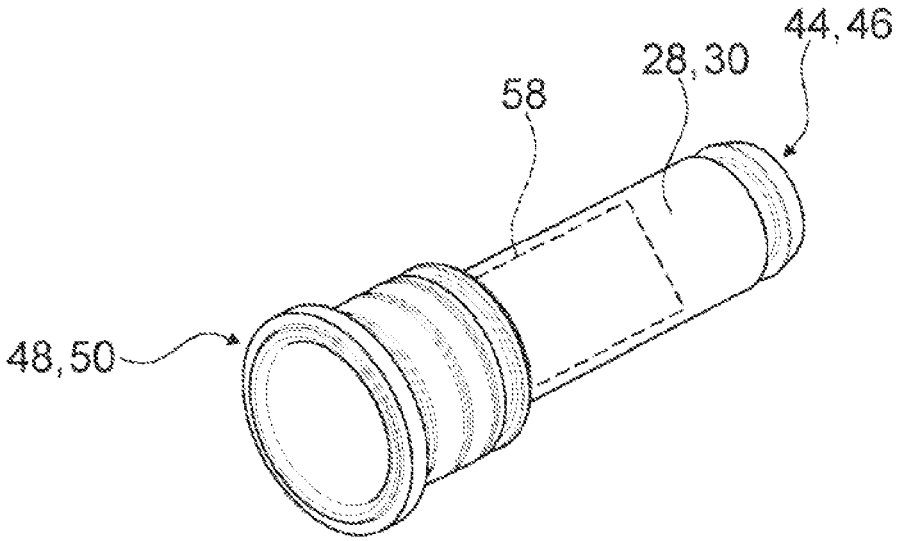
FIG. 10 shows a schematic illustration of a fluid supply adapter or a fluid discharge adapter of the conveyor device according to the disclosure.

The conveyor device 12 comprises at least one functional unit 58, in particular a filter unit and/or a valve unit, and the fluid supply adapter 28 and/or the fluid discharge adapter 30, wherein the functional unit 58 is arranged at least partly, in particular completely, in the fluid supply adapter 28 and/or in the fluid discharge adapter 30 (cf. FIGS. 2, 3 and 10). Preferably, the functional unit 58 is at least partly, in particular completely, firmly integrated in the fluid supply adapter 28 and/or in the fluid discharge adapter 30 or is at least partly, in particular completely, interchangeably arranged in the fluid supply adapter 28 and/or in the fluid discharge adapter 30. The functional unit 58, for example, can have one, in particular two, filter and/or valve cartridge(s) which are/is arranged in the fluid supply adapter 28 and/or in the fluid discharge adapter 30. Other configurations or arrangements of the functional unit 58 that appear to make sense to a person skilled in the art are also conceivable, such as, for example, an arrangement between the connection piece 38 and the fluid supply adapter 28 or between the, in particular, further connection piece 40 and the fluid discharge adapter 30 or the like.

The fluid supply adapter 28 and/or the fluid discharge adapter 30 are/is removably arranged on the housing 14, in particular on the housing upper part 36, and/or on the conveyor chamber element 20. The pump 10 comprises at least one securing unit 42 for securing the fluid supply adapter 28 and/or the fluid discharge adapter 30 to the housing 14, in particular to the housing upper part 36, by means of a form- and/or force-fitting connection. Preferably, the securing unit 42 comprises one, in particular two, external threads which are arranged in particular on an outer face of the receptacle(s) 32, 34 (cf. FIG. 1). It is conceivable that the securing unit 42 comprises at least one, in particular two, screw cap(s) (not shown in more detail here) which cooperates/cooperate with the external thread(s) to secure the fluid supply adapter 28 and/or the fluid discharge adapter 30 to the housing 14, in particular to clamp a collar of the fluid supply adapter 28 and/or the fluid discharge adapter 30. Alternatively or additionally, the securing unit 42 preferably comprises at least the internal thread(s) arranged on the receptacle(s) 32, 34. Furthermore, it is conceivable that the securing unit 42, alternatively or additionally, comprises further components which appear to a person skilled in the art to be useful for securing the fluid supply adapter 28 and/or the fluid discharge adapter 30 to the housing 14, in particular to the housing upper part 36, by means of a form-fitting and/or force-fitting connection, such as, for example, a locking ring, a locking pin or the like.

The conveyor device 12 comprises at least one movement compensation unit 52, which is provided at least for the purpose of at least partially compensating and/or damping relative movements between the fluid supply adapter 28 and the connection piece 38 in a state when the connection piece 38 is connected to the fluid supply adapter 28 and/or for at least partially compensating and/or damping relative movements between the fluid supply adapter 30 and the, in particular further, connection piece 40 in a state when the, in particular further, connection piece 40 is connected to the fluid discharge adapter 30 (cf. FIG. 3). The movement compensation unit 52 preferably comprises at least one damping element 54, in particular at least two damping elements 54, 56. Preferably, the damping element(s) 54, 56 is/are formed as an O-ring. However, it is also conceivable that the damping element(s) 54, 56 has/have a different configuration which appears to make sense to a person skilled in the art, such as an elastomer disc, an elastomer hollow cylinder or the like. Preferably, the damping element(s) 54, 56 is/are arranged between the connection piece 38 and the fluid supply adapter 28 or between the, in particular, further connection piece 40 and the fluid discharge adapter 30. In particular, the damping element(s) 54, 56 rests/rest against an inner face of the connection piece 38 and against an outer face of the inlet end 44 of the fluid supply adapter 28 or against an inner face of the, in particular further, connection piece 40 and against an outer face of the inlet end 46 of the fluid discharge adapter 30. Preferably, the damping element(s) 54, 56 is/are provided, in particular in addition to damping a movement, fora fluidic sealing between the connection piece 38 and the fluid supply adapter 28 or for a fluidic sealing between the, in particular, further connection piece 40 and the fluid discharge adapter 30.

Figure 6:
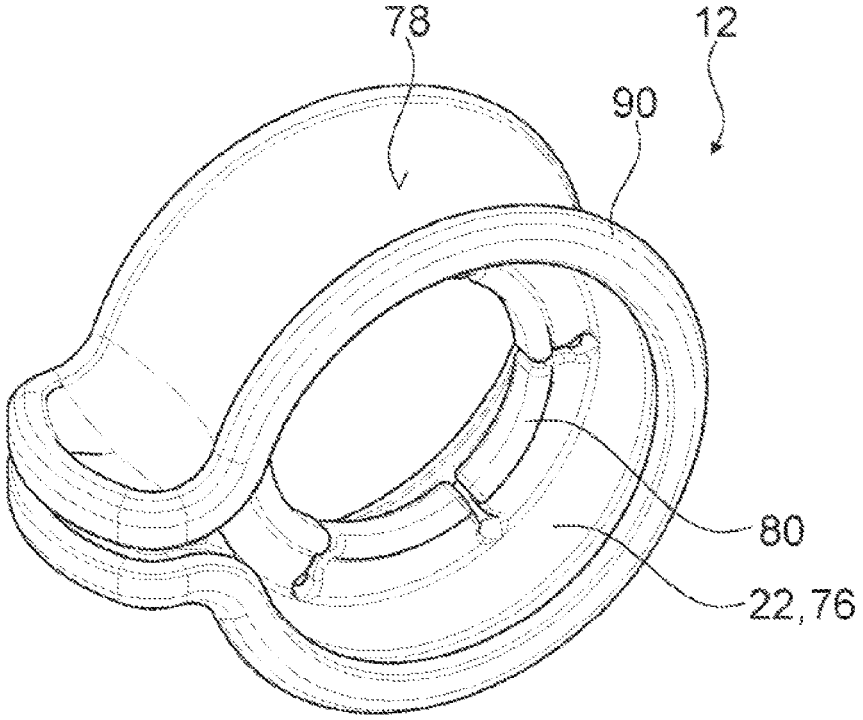

The conveyor element 22 comprises at least one base body, in particular at least one substantially annular base body 76 (cf. FIGS. 3 and 6) which is elastically deformable and has at least one conveyor surface 78 which is arranged on a conveyor side of the base body 76. Furthermore, the conveyor element 22 preferably comprises at least one activation extension 80, in particular a plurality of activation extensions 80, for a connection with at least one transmission element 82 of the drive unit 16, which transmission element cooperates with the activation extension 80, in particular with the plurality of activation extensions 80, on an activation side of the base body 76. Preferably, the conveyor side of the base body 76 is arranged on the base body 76 on a side of the base body 76 facing away from the activation side of the base body 76. In particular, the conveyor side forms an outer face of the basic body 76. Preferably, the activation side forms an inner face of the base body 76. In particular, the activation side forms at least partially an inner face of the base body 76. The activation extension 80, in particular the activation extensions 80, is/are in particular formed integrally with the base body 76. However, it is also conceivable that the activation extension 80, in particular the activation extensions 80, is/are formed separately from the base body 76 and is/are fixed to the base body 76 by means of a form-fitting and/or force-fitting connection which appears to make sense to a person skilled in the art.

The activation extension 80, in particular the activation extensions 80, is/are formed as a form- and/or force-fitting element(s) which cooperates/cooperate with the transmission element 82, at least for transmitting a driving force acting in a direction facing away from the activation side by means of a form- and/or force-fitting connection, in particular by means of an adhesive-free form- and/or force-fitting connection. Preferably, the activation extension 80, in particular the activation extensions 80, is clamped between two transmission elements 82, in particular transmission rings, which are arranged on the drive element 24 (cf. FIG. 4). The activation extension 80, in particular the activation extensions 80 together, has/have a maximum longitudinal extent which is smaller than a maximum longitudinal extent of the base body 76, in particular as viewed along a circumferential direction running around the drive axis 70 of the drive unit 16.

Preferably, viewed in a plane, in particular in a plane extending at least substantially perpendicular to the drive axis 70, the base body 76 has a cross-sectional shape which is substantially composed of a circular arc or an open ring and two inlet and/or outlet extensions extending transverse to the circular arc or the open ring. The circular arc or open ring of the cross-sectional shape of the base body 76 preferably extends along an angular range of less than 360° and in particular of more than 90°. The inlet and/or outlet extensions of the cross-sectional shape of the base body 76 extending transverse to the circular arc or the open ring are preferably arranged directly adjacent to the circular arc or the open ring, in particular in end regions of the circular arc or the open ring. The activation extension 80, in particular the activation extensions 80, preferably extends/extend along a closed circular ring, wherein the activation extension 80, in particular the activation extensions 80, can themselves form the circular ring. A maximum extent of the activation extension 80 along a central axis of the base body 76 or a total extent of the plurality of successive activation extensions 80 along the central axis of the base body 76 is in particular at least 5%, preferably at least 10% and most preferably at least 20% smaller than a maximum longitudinal extent of the base body 76. Preferably, the activation extension 80 or the plurality of successive activation extensions 80 together extend along an angular range of, in particular, more than 270°, preferably of less than 360° or of 360° at the activation side.

Figure 5:
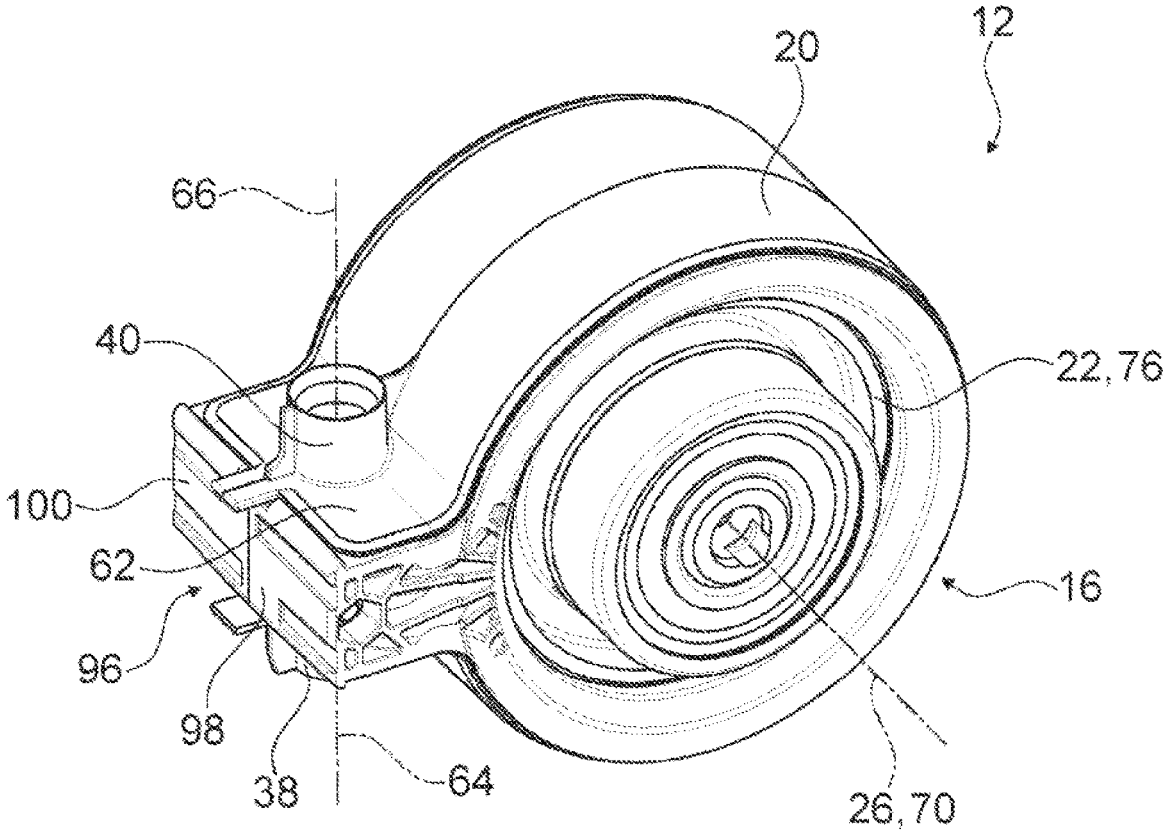
FIG. 5 shows a schematic illustration of the conveyor device according to the disclosure in a state when removed from the housing of the pump.

The conveyor chamber element 20 surrounds the conveyor element 22 along a circumferential direction, in particular in a plane extending at least substantially perpendicular to the drive axis 70 of the drive unit 16, at least to a large extent (cf. FIGS. 3 and 5). The conveyor chamber element 20 is annular in shape. Preferably, the conveyor chamber element 20 and the conveyor element 22 have an at least substantially analogous shape, in particular as viewed in the plane extending at least substantially perpendicular to the drive axis 70 of the drive unit 16. In particular, the conveyor chamber element 20 and the conveyor element 22, in particular the base body 76 of the conveyor element 22, have a basic shape that resembles a Greek omega as a capital letter, wherein preferably the extensions of the conveyor chamber element 20 and the conveyor element 22 are angled by 90° compared to extensions of the Greek capital letter omega.

Figure 4:
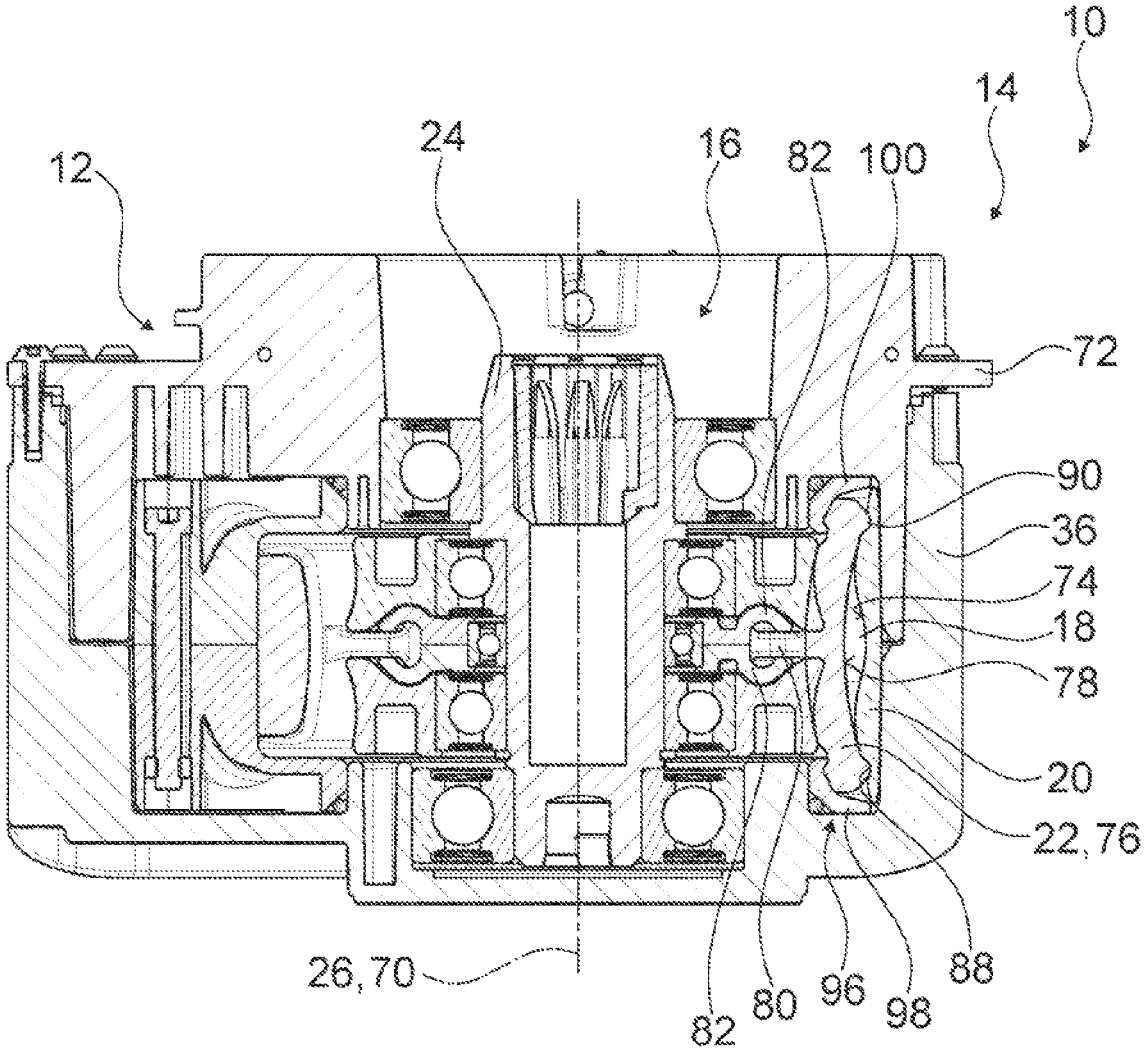
FIG. 4 shows another sectional view through the pump according to the disclosure in a schematic illustration.
Figure 7:
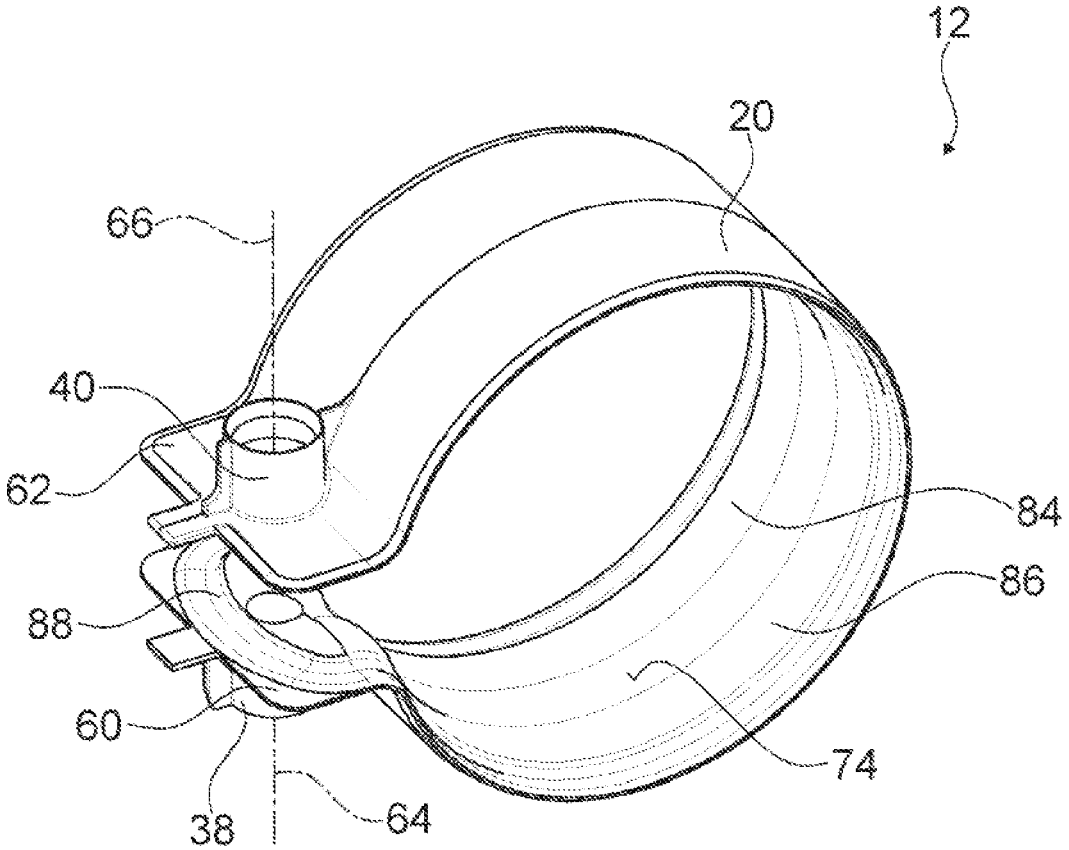
FIG. 7 shows a schematic illustration of a conveyor chamber element of the conveyor device according to the disclosure.
Figure 8:
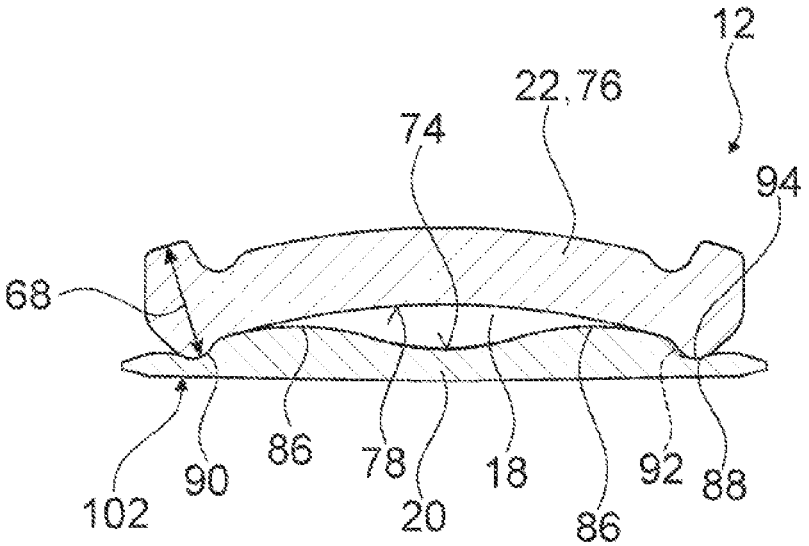
FIG. 8 shows a partial sectional view through the conveyor element and the conveyor chamber element in a schematic illustration, FIG. 9 a schematic illustration of a pressing element of a pressing unit of the conveyor device according to the disclosure.

The conveyor chamber element 20 has a counter surface 74 cooperating with the conveyor surface 78 of the conveyor element 22 for conveying a fluid, which counter surface faces the conveyor element 22 and has at least one elevation 84, 86 directed towards the conveyor element 22 (cf. FIGS. 4, 7 and 8). Preferably, the counter surface 74 comprises at least two elevations 84, 86 directed towards the conveyor element 22. The elevation(s) 84, 86, viewed along the circumferential direction, extend/extends along an at least substantially entire inner face, in particular circular arc-shaped inner face of the conveyor chamber element 20. Preferably, the elevation(s) 84, 86 extends/extend along the inner face of the conveyor chamber element 20, starting from one of the transverse extensions 60, 62, along the circular arc or the open ring up to the other one of the transverse extensions 60, 62.

The conveyor element 22, in particular the base body 76, includes the conveyor surface 78 which, viewed in a cross-section of the conveyor element 22, in particular in a cross-section of the conveyor chamber element 18, has a maximum transverse extent which corresponds at least substantially, in particular completely, to a maximum transverse extent of the counter surface 74 of the conveyor chamber element 20 (cf. FIGS. 4 and 8). For conveying a fluid into and/or through the conveyor chamber 18, the conveyor surface 78 can be placed, in particular completely placed, against the counter surface 74 of the conveyor chamber element 20 as a result of the action of a driving force which can be generated by the drive unit 16. The counter surface 74 of the conveyor chamber element 20, viewed in a cross-section of the conveyor chamber element 20, has at least three successive circular arc sections. The circular arc sections form the counter surface 74. Two of the three circular arc sections form the elevations 84, 86 of the counter surface 74 and are arranged on the outside. One of the three arc sections forms a recess and is arranged on the inside, in particular between the elevations 84, 86. It is conceivable that the three circular arc sections have different or the same radii.

The conveyor chamber element 20 has at least one connecting region, in particular at least one connecting groove, preferably sealing groove 88, arranged in particular on the inner face of the conveyor chamber element 20, into which groove at least one edge region of the conveyor element 22, in particular an extension, preferably sealing extension 90, of the conveyor element 22 arranged on the edge of the conveyor element 22, engages, in particular sealingly engages, in a state when arranged on the conveyor chamber element 20 (cf. FIGS. 4 and 8). The conveyor element 22 includes at least the sealing extension 90 which is formed integrally with the base body 76 of the conveyor element 22 and, in a state when the conveyor element 22 is arranged on the conveyor chamber element 20, is arranged at least partly in the sealing groove 88 of the conveyor chamber element 20. The sealing groove 88 is formed in such a manner that a flat contact area is created between the sealing extension 90 and an edge region 92 of the conveyor chamber element 20 delimiting the sealing groove 88. The sealing groove 88 and the edge region 92 of the conveyor chamber element 20 delimiting the sealing groove 88, which edge region is arranged on a side of the sealing groove 88 facing the conveyor surface 78 of the base body 76 of the conveyor element 22, are formed in such a manner that a flat contact area of the sealing extension 90 on the edge region 92 of the conveyor chamber element 20 delimiting the sealing groove 88 and on a groove base 94 of the sealing groove 88 is created. The sealing groove 88 extends completely around the counter surface 74 of the conveyor chamber element 20, which counter surface cooperates with the conveyor surface 78 of the base body 76 of the conveyor element 22 to convey a fluid and delimits the counter surface 74. Preferably, the sealing groove 88 on the transverse extensions 60, 62 of the conveyor chamber element 20 extends around an inlet or outlet opening in the respective transverse extension 60, 62 and transitions, in particular seamlessly, into the annular inner face of the conveyor chamber element 20, in particular to delimit the counter surface 74. Preferably, the sealing groove 88 extends along an entire inner peripheral region of the conveyor chamber element 20. For the purpose of cooperating with the conveyor surface 78 of the base body 76 of the conveyor chamber element 22 for conveying a fluid, the conveyor chamber element 20 has the counter surface 74 which, in particular viewed in a cross-section, extends over at least three successive circular arc sections, wherein at least the edge region 92 of the conveyor chamber element 20 delimiting the sealing groove 88 is arranged in particular directly adjacent to at least one of the three arcuate sections, in particular an outer one. The sealing extension 90 extends completely around the conveyor surface 78 of the base body 76 of the conveyor element 22 and delimits the conveying surface 78. Preferably, the sealing extension 90 extends along an entire outer circumference of the base body 76. Preferably, the sealing extension 90 extends around the inlet and/or outlet extensions of the base body 76 and transitions, in particular seamlessly, into the annular base shape of the base body 76, in particular to delimit the conveying surface 78. Preferably, the sealing extension 90 has a transition region to an edge region of the base body 76 of the conveyor element 22, which transition region has a cross-section that is different from a cross-section of a further transition region of the sealing extension 90 to the conveyor surface 78 of the base body 76 (cf. FIG. 8).

Figure 9:
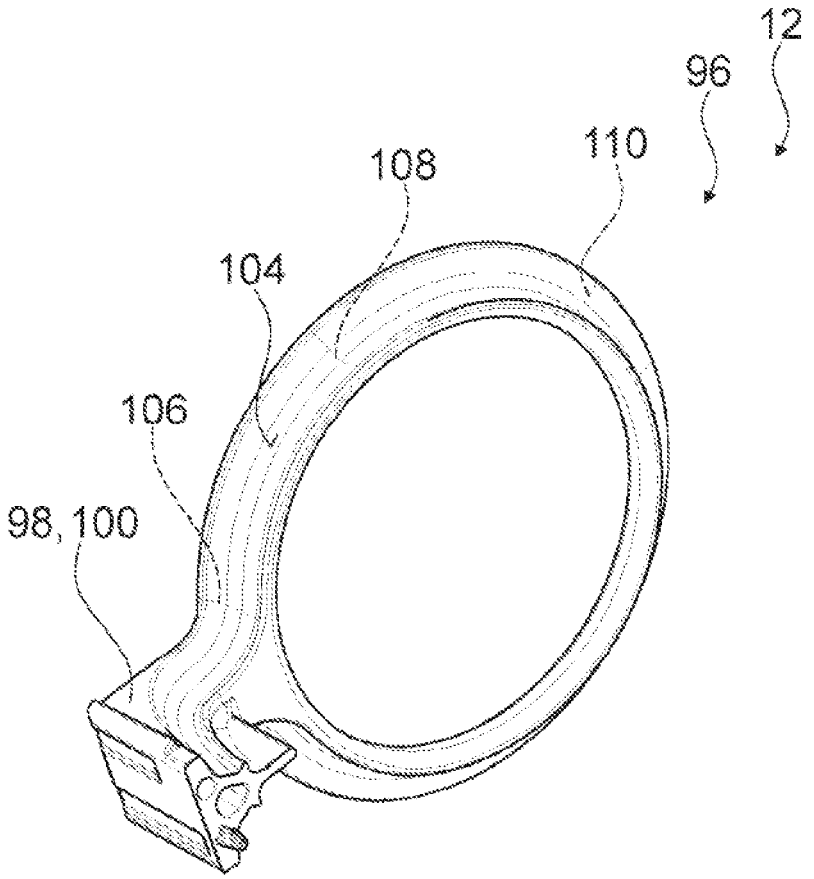

Furthermore, the conveyor device 12 comprises at least one pressing unit 96 which has at least one pressing element 98, 100, in particular at least one clamping ring, which pressing element is provided for applying a contact pressing force to the sealing extension 90 in the direction of the conveyor chamber element 20 and for compressing the sealing extension 90 at least in the region of the sealing groove 88 (cf. FIGS. 4, 5 and 9). The sealing extension 90 extends along a direction transverse, in particular at least substantially perpendicular, to the conveyor surface 78 of the base body 76 of the conveyor element 22 across the conveyor surface 78. The pressing unit 96, in particular at least in a non-conveying state of the conveyor element 22, is provided for generating an inhomogeneous contact pressing force at least in a sealing region 102 between the conveyor element 22 and the conveyor chamber element 20 along a maximum overall extent of the sealing region 102, in particular along a maximum circumferential extent between the conveyor element 22 and the conveyor chamber element 20. Preferably, the sealing region 102 is formed by the sealing groove 88 and the sealing extension 90 cooperating. Preferably, the sealing region 102 is formed by a contact surface between the sealing extension 90 and the sealing groove 88. The pressing unit 96 is preferably provided to generate an inhomogeneous contact pressing force distribution along a sealing line of the conveyor element 22, in particular along a circumferential direction of the conveyor element 22. The sealing line is preferably formed by the sealing extension 90.

Preferably, the pressing unit 96 is designed in such a manner that, in particular at least in a non-conveying state of the conveyor element 22, the conveyor element 22 has an inhomogeneous compression along the maximum overall extent of the sealing region 102 or the sealing line, in particular along a maximum circumferential extent of the annular conveyor element 22. The pressing unit 96 has at least one pressing element 98, 100, in particular at least one clamping ring, wherein the conveyor element 22 is annular in shape and is pressed against an inner circumference of the annular conveyor chamber element 20 by means of the pressing element 98, 100. Preferably, the pressing unit 96 comprises at least two pressing elements 98, 100, in particular two clamping rings, between which the conveyor element 22 is arranged within the conveyor chamber element 20. Preferably, the conveyor element 22 can be pressed against the inner circumference of the annular conveyor chamber element 20 by means of the pressing elements 98, 100. In particular, the sealing extension 90 is pressed into the sealing groove 88 by the pressing element 98, 100 acting on the conveyor element 22. The pressing unit 96 includes at least the pressing element 98, 100, in particular at least the clamping ring, wherein the conveyor chamber element 22 includes at least the sealing extension 90 and wherein the pressing element 98, 100 presses the sealing extension 90, in particular at least along a circumferential direction of the conveyor chamber element 20, against the conveyor chamber element 20, in particular with a contact pressing force that is inhomogeneous along the circumferential direction. The pressing unit 96 includes at least the pressing element 98, 100, in particular at least the clamping ring, which has a pressing surface 104 which, along a maximum longitudinal extent of the pressing surface 104, in particular along a circumferential direction of the pressing element 98, 100, has a varying height, in particular a varying distance relative to a surface facing away from the pressing surface 104, in particular an inner surface of the pressing element 98, 100. The varying height of the pressing surface 104 is preferably formed by different maximum heights of the pressing surface 104 along the circumferential direction. By way of example, three different positions 106, 108, 110 on the pressing element 98, at which the pressing surface 104 is provided for generating different degrees of compression of the sealing extension 90, are indicated by dashed lines in FIG. 9. In particular, the pressing surface 104 has different maximum heights at the three different positions 106, 108, 110, which can be formed in a variety of ways, such as by changing a maximum thickness of the pressing element 98 at the three positions 106, 108, 110 compared to other positions of the pressing element 98, by changing a geometric profile of the pressing surface 104 on a side of the pressing element 98 facing the conveyor element 22, or in any other way that appears to make sense to a person skilled in the art. For example, as a result of the varying height, the sealing extension 90 is compressed to different degrees at positions 106, 108, 110. At position 106, for example, the sealing extension 90 is compressed by, in particular, more than 10%, preferably by more than 15%, preferably by more than 20% and most preferably by more than 22% of a maximum thickness 68 of the sealing extension 90. At position 108, the sealing extension 90 is compressed, for example, by more than 5%, preferably by more than 10%, preferably by more than 15% and most preferably by more than 19% of a maximum thickness 68 of the sealing extension 90. At position 110, for example, the sealing extension 90 is compressed by, in particular, more than 4%, preferably by more than 8%, preferably by more than 14% and most preferably by more than 16% of the maximum thickness 68 of the sealing extension 90.

The pressing unit 96 includes at least the pressing element 98, in particular at least the clamping ring, and at least one further pressing element 100, in particular at least one further clamping ring, wherein the conveyor element 22 is annular in shape and is pressed against an inner circumference of the annular conveyor chamber element 20 by means of the pressing element 98 and the further pressing element 100, wherein the pressing element 98 and the further pressing element 100 are arranged on the conveyor element 22 on sides of the conveyor element 22 facing away from one another. Preferably, the pressing element 98 and the further pressing element 100 of the pressing unit 96 have an at least substantially analogous configuration. The pressing element 98 and the further pressing element 100 are arranged mirror-symmetrically on the conveyor chamber element 20, in particular in order to press the conveyor element 22 against the conveyor chamber element 20 and to press the sealing extension 90 into the sealing groove 88. The conveyor chamber element 20 includes at least the groove, preferably the sealing groove 88 running in particular along an inner circumference of the annular conveyor chamber element 20, into which at least the sealing extension 90 of the, in particular, annular conveyor element 22 is pressed by means of the pressing element 98, in particular the clamping ring, and/or the further pressing element 100 of the pressing unit 96, wherein compression of the sealing extension 90 is inhomogeneous along a maximum longitudinal extent of the sealing extension 90 extending in particular along a circumferential direction of the conveyor element 22. Alternatively or in addition to a varying height of the pressing surface 104 of the pressing element 98 and/or of the further pressing element 100, it is conceivable that the conveyor element 22 includes at least the sealing extension 90 which is pressed against an inner circumference of the annular conveyor chamber element 20 by means of the pressing unit 96 and has a maximum thickness 68 which varies along the maximum longitudinal extent of the sealing extension 90, in particular along a circumferential direction of the conveyor element 22. Further configurations of the pressing unit 96 for generating an inhomogeneous compression of the sealing extension 90 along the circumferential direction in the sealing region 102 which appear to make sense to a person skilled in the art are also conceivable.

The invention claimed is:

1. A pump for conveying a fluid, the pump comprising:

conveyor device including a conveyor chamber, a dimensionally stable conveyor chamber element, an elastically deformable conveyor element, and a drive unit, the elastically deformable conveyor element delimits the conveyor chamber; the elastically deformable conveyor element together with the dimensionally stable conveyor chamber element delimits the dimensionally stable conveyor chamber and is arranged on the dimensionally stable conveyor chamber element, the drive unit configured to act on the conveyor device; and a housing for receiving the conveyor device, wherein the housing is formed separately from the conveyor device as a whole such that the conveyor device can be removed as a whole from the housing, wherein the dimensionally stable conveyor chamber element has an outer face which, in a state when the conveyor device is arranged on the housing, is connected in a force-fitting and/or form-fitting manner to an inner face of the housing, and rests against the inner face of the housing, wherein the conveyor chamber element, at least to a substantial extent, surrounds the elastically deformable conveyor element along a circumferential direction running in a plane extending at least substantially perpendicular to a drive axis of the drive unit.

2. The pump according to claim 1, characterised in that the housing, at least to a substantial extent, surrounds the elastically deformable conveyor chamber element, in particular the conveyor device, along a circumferential direction running in a plane extending at least substantially perpendicular to the drive axis of the drive unit.

3. The pump according to claim 1, characterised in that the dimensionally stable conveyor chamber element, viewed along a direction running transverse to the drive axis of the drive unit, is arranged at least between the housing and the elastically deformable conveyor element of the conveyor device, in particular directly adjacent to the housing and to the conveyor element or directly resting against the housing and the elastically deformable conveyor element.

4. A conveyor device for a pump, in particular for a pump according to claim 1, wherein the dimensionally stable conveyor chamber element, at least to a substantial extent, surrounds the elastically deformable conveyor element along a circumferential direction running in particular in a plane extending at least substantially perpendicularly to the drive axis of a drive unit, and wherein the dimensionally stable conveyor chamber element is formed, at least to a large extent, in particular completely, from a plastic material, in particular from an injection-moulded plastic material.

5. The conveyor device according to claim 4, characterised in that the dimensionally stable conveyor chamber element is annular in shape.

6. The conveyor device according to claim 4, characterised in that the dimensionally stable conveyor chamber element has a counter surface which cooperates with a conveyor surface of the elastically deformable conveyor element for conveying a fluid and which faces the elastically deformable conveyor element and has at least one elevation directed in the direction of the elastically deformable conveyor element.

7. The conveyor device according to claim 6, characterised in that the elevation, viewed along the circumferential direction, extends along an at least substantially entire inner face of the dimensionally stable conveyor chamber element, which inner face extends in particular in circular-arc-shaped manner.

8. The conveyor device according to claim 4, characterised in that the dimensionally stable conveyor chamber element has a sealing groove arranged on an inner face of the dimensionally stable conveyor chamber element conveyor element, so as to seal the dimensionally stable conveyor chamber element to the elastically deformable conveyor element.

9. The conveyor device according to claim 4, characterised in that the conveyor chamber element includes a first connection piece for a first fluid supply adapter and a second connection piece for a second fluid discharge adapter, the first connection piece and the second connection piece arranged on an outer face of the dimensionally stable conveyor chamber element so as to face away from the conveyor element.

10. The conveyor device according to claim 4, characterised in that the elastically deformable conveyor element is formed, at least to a substantial extent from a rubber.

* * * * *